US008230713B2

(12) United States Patent
Krajewski et al.

(10) Patent No.: US 8,230,713 B2
(45) Date of Patent: Jul. 31, 2012

(54) ELEVATED TEMPERATURE FORMING DIE APPARATUS

(75) Inventors: Paul Edward Krajewski, Troy, MI (US); Richard Harry Hammar, Shelby Township, MI (US); Dajun Zuo, Rochester Hills, MI (US); Peter A. Friedman, Ann Arbor, MI (US); S. George Luckey, Jr., Dearborn, MI (US); Dennis Cedar, Rochester, MI (US)

(73) Assignee: USAMP, Southfield, MI (US)

( * ) Notice: Subject to any disclaimer, the term of this patent is extended or adjusted under 35 U.S.C. 154(b) by 829 days.

(21) Appl. No.: 12/346,312

(22) Filed: Dec. 30, 2008

(65) Prior Publication Data

US 2010/0166903 A1 Jul. 1, 2010

(51) Int. Cl.
*B21D 26/02* (2011.01)
*B21D 25/00* (2006.01)

(52) U.S. Cl. ..... 72/342.7; 72/342.8; 72/350; 29/421.1

(58) Field of Classification Search ..... 72/57, 60, 72/342.1, 342.7, 342.8, 296, 297, 350, 709; 29/421.1

See application file for complete search history.

(56) References Cited

U.S. PATENT DOCUMENTS 3,340,714 A * 9/1967 Pohl et al. ..... 72/342.4
3,584,487 A * 6/1971 Carlson ..... 72/38
4,754,635 A * 7/1988 van den Berg et al. ..... 72/350
4,902,215 A 2/1990 Seemann, III
5,900,311 A 5/1999 Campanella et al.
5,904,972 A 5/1999 Tunis, III et al.
6,159,414 A 12/2000 Tunis, III et al.
6,309,732 B1 10/2001 Lopez-Anido et al.
6,455,131 B2 9/2002 Lopez-Anido et al.
6,463,779 B1 10/2002 Terziakin
6,565,792 B2 5/2003 Hemphill
6,586,054 B2 7/2003 Walsh
6,805,546 B2 10/2004 Hahn et al.
6,840,750 B2 1/2005 Thrash et al.
6,890,394 B2 5/2005 Carsley et al.
6,910,358 B2 * 6/2005 Schroth ..... 72/57
7,047,779 B2 * 5/2006 Kruger et al. ..... 72/57
7,112,249 B2 * 9/2006 Schroth et al. ..... 148/511
(Continued)

*Primary Examiner* — David Jones
(74) *Attorney, Agent, or Firm* — Reising Ethington P.C.

(57) ABSTRACT

An elevated temperature forming die apparatus comprising a lower die part having a first upper surface positioned to engage a lower surface of a first region of such a workpiece, an upper die part supported for reciprocal motion relative to the lower die part, the upper die part having a lower surface that engages an upper surface of a second region of a sheet material workpiece, heaters in thermal communication with the die parts, and a third die part having an upper surface that engages a lower surface of the second region of a sheet material workpiece whose first portion is positioned between the upper and lower die parts, the third die part being supported for reciprocal motion relative to the upper die part such that closure of the upper die part along the first stroke portion against the third die part will clamp the first portion of the workpiece between the upper and third die parts, and the third die part being supported for reciprocal motion relative to the lower die part such that, once the first portion of a workpiece has been clamped between the upper and third die parts a draw region of the workpiece extending adjacent an interface between the first and second portions of the workpiece can be drawn by displacing the lower die part relative to the clamped-together upper and third die parts along a second portion of the die set stroke.

36 Claims, 7 Drawing Sheets

U.S. PATENT DOCUMENTS

| | | | | |
|---|---|---|---|---|
| 7,159,437 | B2 | 1/2007 | Schroth et al. | |
| 7,199,334 | B2 | 4/2007 | Friedman et al. | |
| 7,204,119 | B2 * | 4/2007 | Kruger et al. | 72/342.7 |
| 7,210,323 | B2 * | 5/2007 | Kruger et al. | 72/57 |
| 7,614,270 | B2 * | 11/2009 | Luckey et al. | 72/57 |
| 2002/0167119 | A1 | 11/2002 | Hemphill | |
| 2002/0185785 | A1 | 12/2002 | Thrash et al. | |
| 2003/0075840 | A1 | 4/2003 | Hahn et al. | |
| 2004/0051214 | A1 | 3/2004 | Sheu et al. | |
| 2004/0135294 | A1 | 7/2004 | Thrash et al. | |

* cited by examiner

ELEVATED TEMPERATURE FORMING DIE APPARATUS

STATEMENT REGARDING FEDERALLY SPONSORED RESEARCH OR DEVELOPMENT

The U.S. government has a paid-up license in this invention and the right in limited circumstances to require the patent owner to license others on reasonable terms as provided for by the terms of Cooperative Agreement No. DE-FC26-02OR22910 awarded by the Department of Energy.

CROSS-REFERENCES TO RELATED APPLICATIONS

Not Applicable

BACKGROUND OF THE INVENTION

1. Field of the Invention

This invention relates generally to an elevated temperature forming die apparatus for fabrication of deep draw panels such as door inners from workpieces with limited formability such as aluminum or magnesium sheet material.

2. Description of the Related Art Including Information Disclosed Under 37 CFR 1.97 and 1.98

Elevated temperature forming methods and die apparatus are known in the art. For example, U.S. Pat. No. 7,159,437 issued 9 Jan. 2007 to Schroth, et al., discloses an elevated temperature forming method and a die apparatus that includes a hot forming tool including a die set comprising a lower die part having a forming surface shaped complementary to a desired shape of a portion of the metal sheet workpiece and an upper die part supported for reciprocal motion relative to the lower die part along a die set stroke extending between open and closed die set positions and having a forming surface shaped complementary to a desired shape of a portion of the workpiece such that relative movement of the upper and lower die parts to the closed die set position imparts a desired shape to a portion of a workpiece positioned between the upper and lower die parts. The Schroth patent also discloses multiple electrical resistance cartridge heaters carried by the upper and lower die parts and positioned using numerical thermal finite element and optimization analysis such that when each heating element is simultaneously powered on for an identical fraction of the time an acceptable temperature distribution will be produced within the tool such that entire forming surfaces of the upper and lower die parts are maintained within a predetermined temperature range. Also disclosed in the Schroth patent is a temperature controller comprising a power controller connected to the cartridge heaters carried by the lower die part and programmed to maintain the forming surface of the lower die part within the predetermined temperature range by controlling power application to the cartridge heaters carried by the lower die part. The Schroth temperature controller also discloses including a second power controller connected to the cartridge heaters carried by the upper die part and programmed to maintain the forming surface of the upper die part within the predetermined temperature range by controlling power application to the cartridge heaters carried by the upper die part. However, the Schroth patent doesn't contemplate the controlled drawing of sheet material workpieces.

What would be desirable would be an elevated temperature forming die apparatus capable of fabricating deep drawn panels such as door inners from sheet workpieces comprising materials of limited formability.

BRIEF SUMMARY OF THE DISCLOSURE

An elevated temperature forming die apparatus is provided for fabrication of deep draw panels from sheet material workpieces having insufficient formability at lower temperatures. The die apparatus may include a die set configured to receive a sheet material workpiece and comprising a lower die part having an upper surface configured to engage a lower surface of a first region of such a workpiece and the die set comprising an upper die part supported for reciprocal motion relative to the lower die part along a first portion of a die set stroke between open and closed die set positions, the upper die part having a lower surface configured to engage an upper surface of a second region of a sheet material workpiece. The elevated temperature forming die apparatus also may include at least one heater in thermal communication with one of the upper and lower die parts, a temperature controller connected to the at least one heater and configured to maintain at least one of the lower surface of the upper die part and the upper surface of the lower die part within a predetermined temperature range by controlling power application to the heaters.

Unlike the prior art of record, the elevated temperature forming die apparatus may also include a third die part having an upper surface configured to engage a lower surface of the second region of a sheet material workpiece whose first portion is positioned between the upper and lower die parts, the third die part being supported for reciprocal motion relative to the upper die part such that closure of the upper die part along the first stroke portion against the third die part will clamp the first portion of the workpiece between the upper and third die parts, and the third die part being supported for reciprocal motion relative to the lower die part such that, once the first portion of a workpiece has been clamped between the upper and third die parts a draw region of the workpiece extending adjacent an interface between the first and second portions of the workpiece can be drawn by displacing the lower die part relative to the upper and third die parts moving together along a second portion of the die set stroke. Therefore, an elevated temperature forming die apparatus constructed according to the invention allows for the controlled drawing of sheet material workpieces.

Alternatively, at least one heater is disposed in thermal communication with the third die part and the temperature controller is connected to the at least one heater in thermal communication with the third die part. The temperature controller may be configured to maintain the draw region of the workpiece within a predetermined temperature range by controlling power application to the at least one heater disposed in thermal communication with the upper die part, the at least one heater disposed in thermal communication with the lower die part, and/or the at least one heater disposed in thermal communication with the third die part. This provides greater control of the temperature maintained in the draw region of the workpiece.

Alternatively, at least one temperature effector may be disposed in a first temperature zone of the die set, and at least one other temperature effector may be disposed in a second temperature zone of the die set. At least one temperature sensor may be electrically coupled to the temperature controller and may be disposed in a position to sense a temperature in the first temperature zone. At least one temperature sensor may be electrically coupled to the temperature controller and may be disposed in a position to sense a temperature of the second temperature zone. The temperature controller may be configured to maintain the first temperature zone within a first predetermined temperature range and the second temperature zone within a second predetermined temperature range by controlling power application to the at least one temperature effector disposed in the first temperature zone and the at least one temperature effector disposed in the second temperature zone in response to temperature feedback signals received from the respective temperature sensors.

Alternatively, the second die part may comprise the first temperature zone, at least one of the upper and third die parts may comprise the second temperature zone, and the controller may be configured to maintain the first temperature zone at a temperature below that of the second temperature zone.

Alternatively, the second die part may include a first temperature zone of the die set, at least one of the upper and third die parts may comprise a second temperature zone of the die set, at least one heater may be disposed in the second temperature zone of the die set, at least one temperature sensor may be electrically coupled to the temperature controller and disposed in a position to sense a temperature in the second temperature zone, and the temperature controller may be configured to maintain the second temperature zone at a temperature above that of the first temperature zone.

Alternatively, the apparatus may include a thermal isolator disposed adjacent the die set and configured to reduce the amount of heat energy conducted from the die set and any workpiece carried by the die set to allow the apparatus to function as a stamping die by preventing die distortion and the overheating of press components.

Alternatively, the thermal isolator may include a cooling system comprising at least one cooling element in thermal communication with an upper plate carrying the upper die part and engageable by an upper platen of a press carrying the apparatus, a sub plate carrying the lower die part and supportable on a lower platen of a press carrying the apparatus, and/or a cushion plate carrying the third die part and supportable on a lower platen of a press carrying the apparatus and configured to draw heat energy from the at least one apparatus component.

Alternatively, the cooling system may comprise a fluid cooling system and the at least one cooling element may comprise a first heat exchanger configured to transfer heat energy from the at least one apparatus component to a coolant fluid and to circulate the coolant fluid through a second heat exchanger disposed remote from the apparatus and configured to transfer heat energy from the coolant fluid.

Alternatively, the thermal isolator may include at least one pillar supporting the third die part on the lower plate to provide further thermal isolation of the die set from the press.

Alternatively, a cushion may be disposed between the at least one pillar and the lower plate and configured to control the rate of force application to the the draw region of a workpiece during the second portion of the die set stroke to control flow of workpiece material into the cavity of the upper die.

Alternatively, the cushion may include at least one cushion cylinder.

Alternatively, the thermal isolator may include at least one pillar supporting the lower die part on the lower plate to provide thermal isolation of the lower die part from a lower platen of a press carrying the apparatus.

Alternatively, the thermal isolator may include at least one pillar supporting the upper die on the upper plate to further thermally isolate the die set from the upper platen of a press.

Alternatively, the thermal isolator may include insulating material disposed between the upper die and the upper plate to further reduce heat transfer from the die set to the upper platen of a press carrying the apparatus, between the lower die part and the sub plate to further reduce heat transfer from the lower die part through the sub plate to other portions of the apparatus and to a lower platen of a press carrying the apparatus, and around a periphery of the die set to reduce radiant heat transfer from the die set.

Alternatively, the thermal isolator may include at least two pillars supporting the upper die on the upper plate and a first one of the at least two pillars may be fixed to the upper die and a second pillar of the at least two pillars may be keyed to the upper die in a direction allowing for upper die expansion along a line extending between the fixed first pillar and the keyed second pillar to control expansion and prevent distortion in the upper die during heating of the upper die.

Alternatively, the lower die part may comprise a punch having an upper forming surface configured to engage a lower surface of the first region of a workpiece and shaped complementary to a desired shape of the lower surface of the first region of a workpiece. The upper die part may include a lower forming surface shaped complementary to a desired shape of an upper surface of the first region of a workpiece such that relative movement of the upper and lower die parts to the closed die set position imparts a desired shape to such first region of a workpiece positioned between the upper and lower die parts, the lower forming surface being recessed in a cavity into which the punch is received during the second portion of the die set stroke.

Alternatively, the apparatus may include two die blocks disposed between an upper plate carrying the upper die part and a sub plate carrying the lower die part and configured to guide die motion along the die set stroke.

Also, a method is provided for making an elevated temperature forming die. The method may include providing a lower die part having an upper surface configured to engage a lower surface of a first region of a sheet material workpiece, providing and supporting an upper die part for reciprocal motion relative to the lower die part along a first portion of a die set stroke between open and closed die set positions, the upper die part having a lower surface configured to engage an upper surface of a second region of a sheet material workpiece and providing at least one heater in thermal communication with one of the upper and lower die parts using numerical thermal finite element and optimization analysis to position the at least one heater such that a desired temperature distribution will be produced within the die set such that at least one of the forming surfaces of the upper and lower die parts is maintained within predetermined temperature range. The method further may include maintaining at least one of the lower surface of the upper die part and the upper surface of the lower die part within a predetermined temperature range by controlling power application to the heaters and providing a third die part having an upper surface configured to engage a lower surface of the second region of a sheet material workpiece whose first portion is positioned between the upper and lower die parts, supporting the third die part for reciprocal motion relative to the upper die part such that closure of the upper die part along the first stroke portion against the third die part will clamp the first portion of the workpiece between the upper and third die parts, and further supporting the third die part for reciprocal motion relative to the lower die part such that, once the first portion of a workpiece has been clamped between the upper and third die parts a draw region of the workpiece extending adjacent an interface between the first and second portions of the workpiece can be drawn by displacing the lower die part relative to the clamped-together upper and third die parts along a second portion of the die set stroke.

Alternatively, the step of providing a lower die part may include supporting the lower die part on a cooled sub plate positioned to reduce heat transferred from the lower die part.

Alternatively, the step of providing a lower die part may include providing a lower die part comprising a punch.

Alternatively, the step of providing and supporting an upper die part may include supporting the upper die part on a cooled upper plate positioned to reduce heat transferred from the upper die part.

Alternatively, the step of providing and supporting an upper die part may include providing upper die pillars between the cooled upper plate and the upper die part.

Alternatively, the step of providing and supporting an upper die part may include positioning the upper die pillars using a numerical thermal finite element and optimization analysis to provide a desired temperature distribution within the die set.

Alternatively, the step of providing and supporting an upper die part may include determining the heights of the upper die pillars using a numerical thermal finite element and optimization analysis.

Alternatively, the step of providing at least one heater in thermal communication with the lower die part and at least one heater in thermal communication with the upper die part may include providing a first plurality of heaters in thermal communication with the lower die part and a second plurality of heaters in thermal communication with the upper die part.

Alternatively, the step of providing at least one heater in thermal communication with the lower die part and at least one heater in thermal communication with the upper die part may include positioning each heater of the first and second pluralities of heaters using numerical thermal finite element and optimization analysis to position such heaters such that a desired temperature distribution will be produced within the die set such that the forming surfaces of the upper and lower die parts are maintained within predetermined temperature ranges.

Alternatively, the step of maintaining the lower surface of the upper die part and the upper surface of the lower die part within respective predetermined temperature ranges may include positioning the heaters of the first and second pluralities of heaters such that the heaters of the two pluralities of heaters are disposed in at least two separate heating zones of the die set, and maintaining a first of the at least two heating zones within a first desired temperature range by controlling power application to the heaters in a first heating zone and maintaining a second of the at least two heating zones within a second predetermined temperature range by controlling power application to the heaters in the second of the two heating zones.

Alternatively, the step of providing a third die part having an upper surface configured to engage a lower surface of the second region of a sheet material workpiece whose first portion is positioned between the upper and lower die parts, supporting the third die part for reciprocal motion relative to the upper die part such that closure of the upper die part along the first stroke portion against the third die part will clamp the first portion of the workpiece between the upper and third die parts, and further supporting the third die part for reciprocal motion relative to the lower die part such that, once the first portion of a workpiece has been clamped between the upper and third die parts a draw region of the workpiece extending adjacent an interface between the first and second portions of the workpiece can be drawn by displacing the lower die part relative to the clamped-together upper and third die parts along a second portion of the die set stroke may include providing at least one heater disposed in thermal communication with the third die part and maintaining the draw region of the workpiece within a predetermined temperature range by controlling power application to any one or more heaters selected from the group of heaters consisting of the at least one heater disposed in thermal communication with the upper die part, the at least one heater disposed in thermal communication with the lower die part, and the at least one heater disposed in thermal communication with the third die part.

Alternatively, the method may include providing a first plurality of heaters in thermal communication with the lower die part, a second plurality of heaters in thermal communication with the upper die part, providing a third plurality of heaters in thermal communication with the third die part such that the heaters of the three pluralities of heaters are disposed in at least two separate heating zones of the die set, and maintaining a first of the at least two heating zones within a first desired temperature range by controlling power application to the heaters in the first heating zone and maintaining a second of the at least two heating zones within a second predetermined temperature range by controlling power application to the heaters in the second of the two heating zones.

Alternatively, each heater of the first, second, and third pluralities of heaters may be positioned using numerical thermal finite element and optimization analysis such that a desired temperature distribution will be produced within the die set.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which.

DETAILED DESCRIPTION OF INVENTION EMBODIMENT(S)

Figure 1:
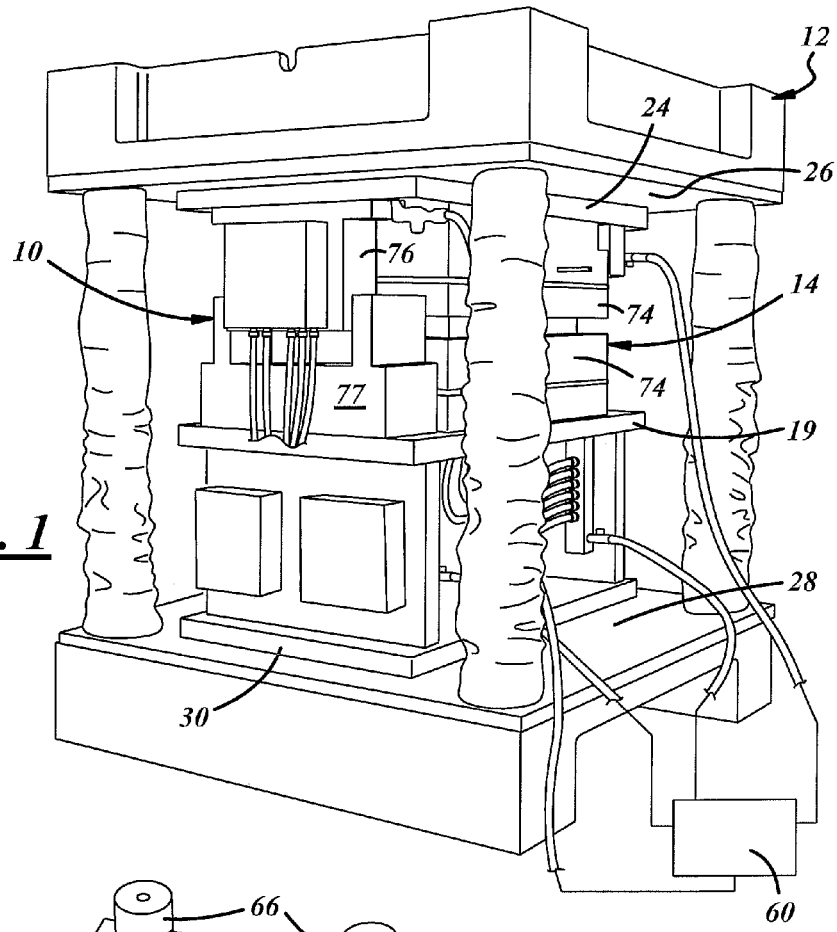
FIG. 1 is a perspective view of a die apparatus constructed according to the invention and carried by a press.
Figure 2:
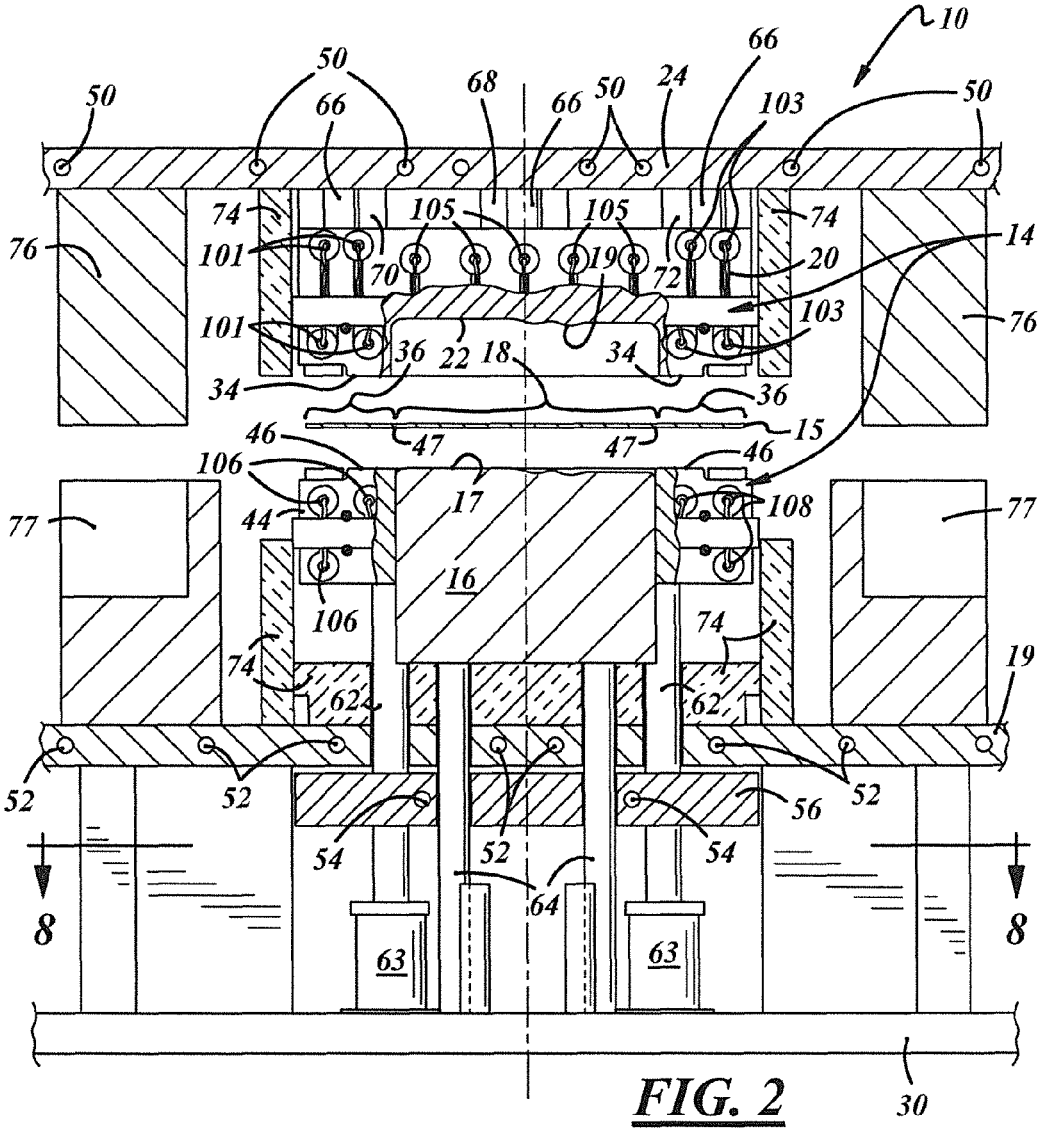
FIG. 2 is a partial cross-sectional perspective view of the die apparatus of FIG. 1 showing an open position of a die set of the apparatus with an upper die part of the die apparatus spaced above a die block and fixed lower die part or punch of the apparatus at a top of a stroke of the die set.
Figure 11:
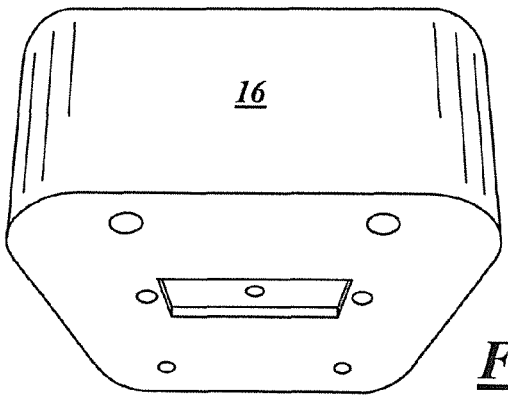
FIG. 11 is a bottom-front perspective view of the lower die part or punch of the apparatus of FIG. 1.

An elevated temperature forming die apparatus for fabrication of deep draw panels such as door inners from sheet material workpieces comprising materials such as aluminum or magnesium having limited formability is generally indicated at 10 in FIGS. 1-4 and 6. In FIG. 1, the die apparatus is shown carried by a press 12. As shown in FIG. 2, the die apparatus 10 may include a die set 14 that may be configured to receive one sheet material workpiece 15 at a time in high-speed stamping operations. In the following description positional modifiers such as the words "upper" and "lower" are used to describe relative positions of apparatus components as shown in the present embodiment. However, in the claims, such terms are used only for convenience, as a way to help differentiate between components, and are not intended to limit any features of the invention to being positioned in any particular attitude relative to earth gravity. Indeed, a die apparatus constructed according to the invention and its component parts may be oriented in any suitable attitude relative to earth gravity as may suit a particular application.

The die set 14 may comprise a "lower" die part 16 such as the punch shown at 16 in the drawings, which may, as best shown in FIG. 2, include an upper forming surface 17 shaped and positioned to engage a lower surface of a first region 18 of a workpiece 15 to be formed into a desired shape. The lower die part 16 may be supported in a fixed position on a stationary cooled sub plate 19.

The die set 14 may also comprise an upper die part 20 such as may include a die cavity 22 for receiving the punch 16 and a lower forming surface 19 disposed within such die cavity 22. As best shown in FIG. 2, the lower forming surface 19 is positioned to engage an upper surface of the first region 18 of a workpiece 15 opposite the upper forming surface 17 of the punch 16. As is also best shown in FIG. 2, the upper die part 20 may include a lower clamp surface 34 that engages an upper surface of a second region 36 of a sheet material workpiece 15. The upper die part 20 may be supported on a cooled upper plate 24 for reciprocal motion relative to the lower die part 16 along a first portion of a die set stroke between open and closed die set 14 positions in response to downward motion of an upper platen 26 of a press 12 toward a lower platen 28 of the press 12 carrying the apparatus 10. The die set 14 is shown in an open die set position in FIG. 2, a clamped position in FIG. 3, and a closed die set position in FIG. 4.

In other words, the lower die part 16 may be a punch 16 having an upper forming surface 17 configured to engage a lower surface of the first region 18 of a workpiece 15 and shaped complementary to a desired shape of the lower surface of the first region 18 of a workpiece 15. The lower forming surface 19 of the upper die part 20 may be shaped complementary to a desired shape of an upper surface of the first region 18 of a workpiece 15 such that relative movement of the upper and lower die parts 16 to the closed die set position imparts a desired shape to such first region 18 of a workpiece 15 positioned between the upper and lower die parts 16, the lower forming surface 19 being recessed in a cavity 22 into which the punch 16 is received during the second portion of the die set stroke.

As shown in FIG. 1, an upper platen 26 of the press 12 engages the upper plate 24 and a lower platen 28 of the press 12 carries a lower plate 30 upon which the cooled sub plate 19 is supported in a stationary position relative to a supporting surface such as a lower press platen 28. However, in other embodiments it could be the upper die part 20 that remains stationary rather than the punch 16, or both could be movable relative to the lower platen 28 and lower plate 30 in response to press action.

Figure 3:
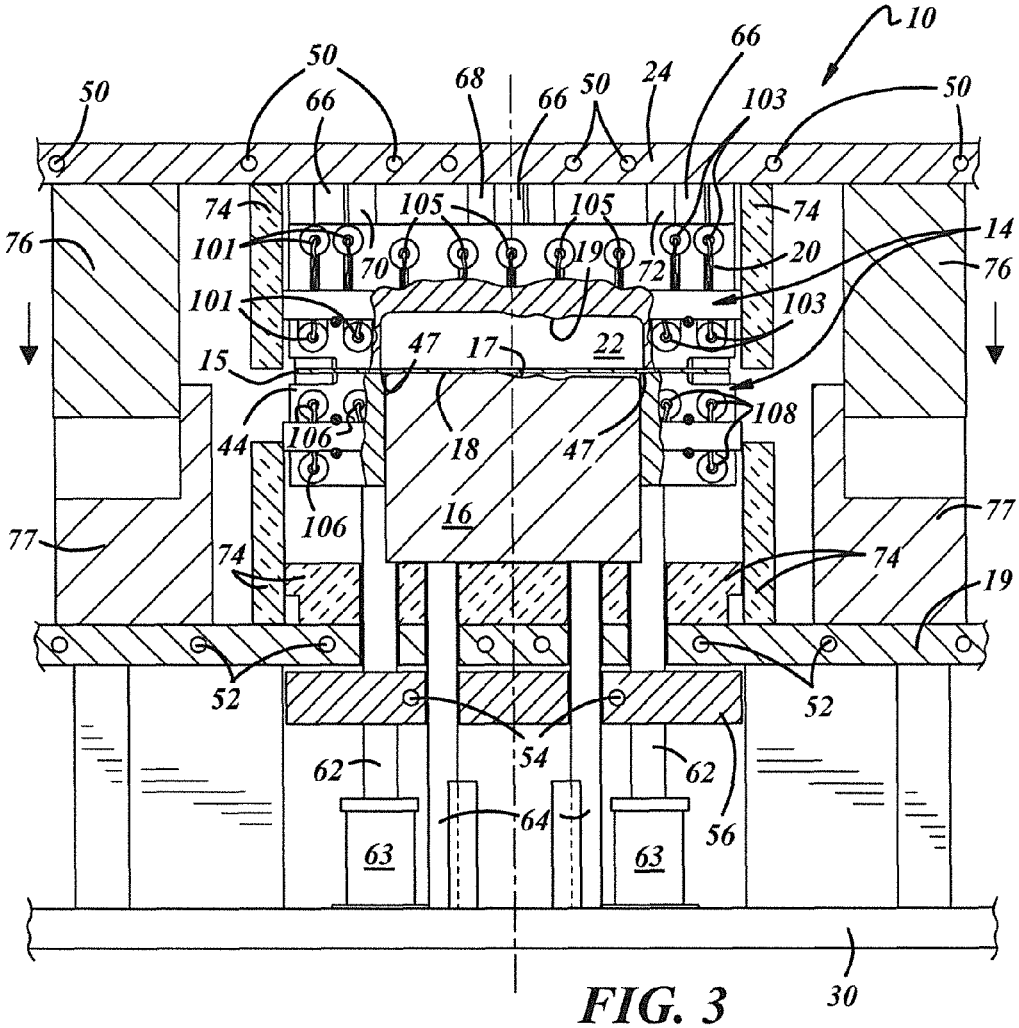
FIG. 3 is a partial cross-sectional perspective view of the die apparatus of FIG. 1 showing the upper die part clamping a sheet material workpiece against the die block in a clamped position part way along the die set stroke.
Figure 4:
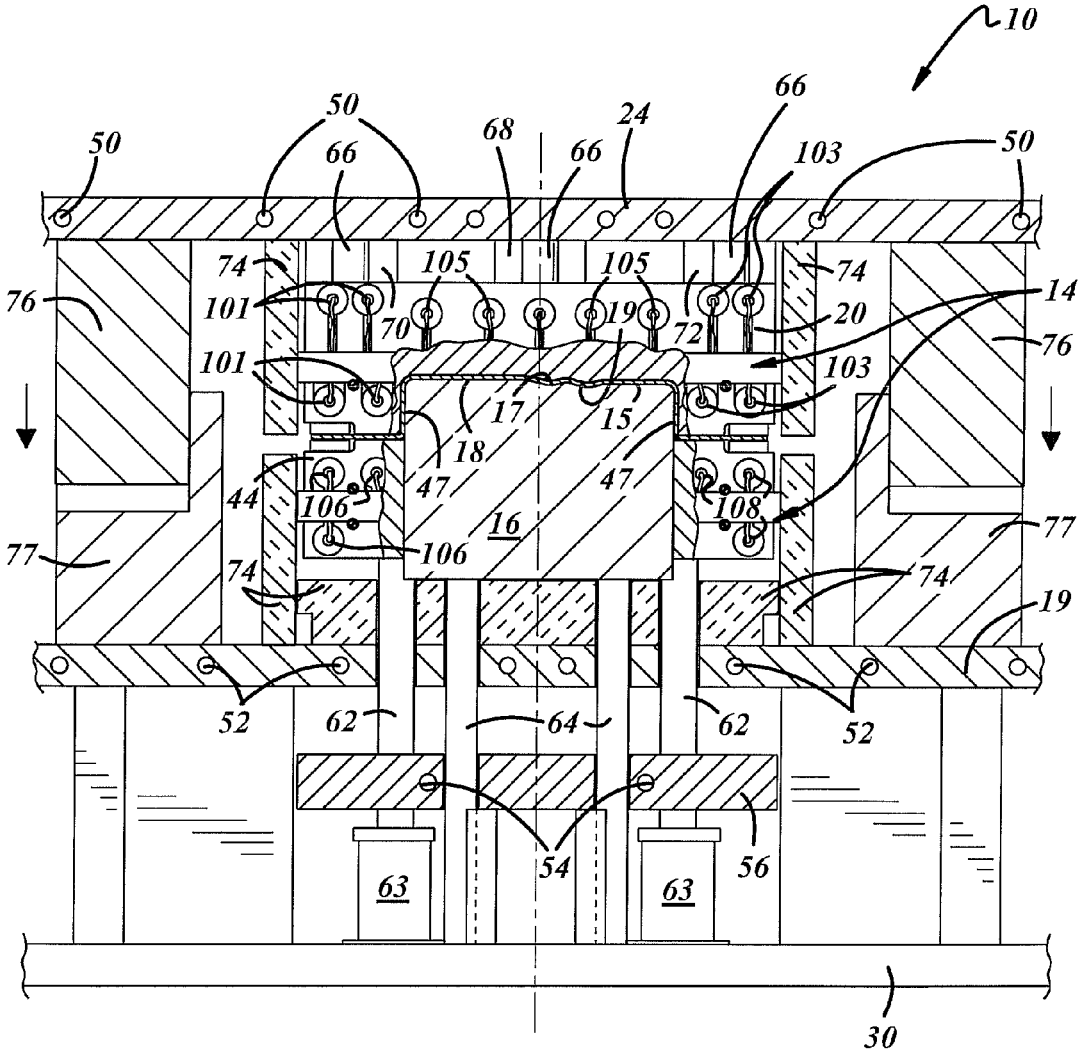
FIG. 4 is a partial cross-sectional perspective view of the die apparatus of FIG. 1 showing the workpiece clamped between the upper die part and die block at a lower end of the die set stroke with the punch and drawn workpiece material received in a cavity of the upper die part.
Figure 6:
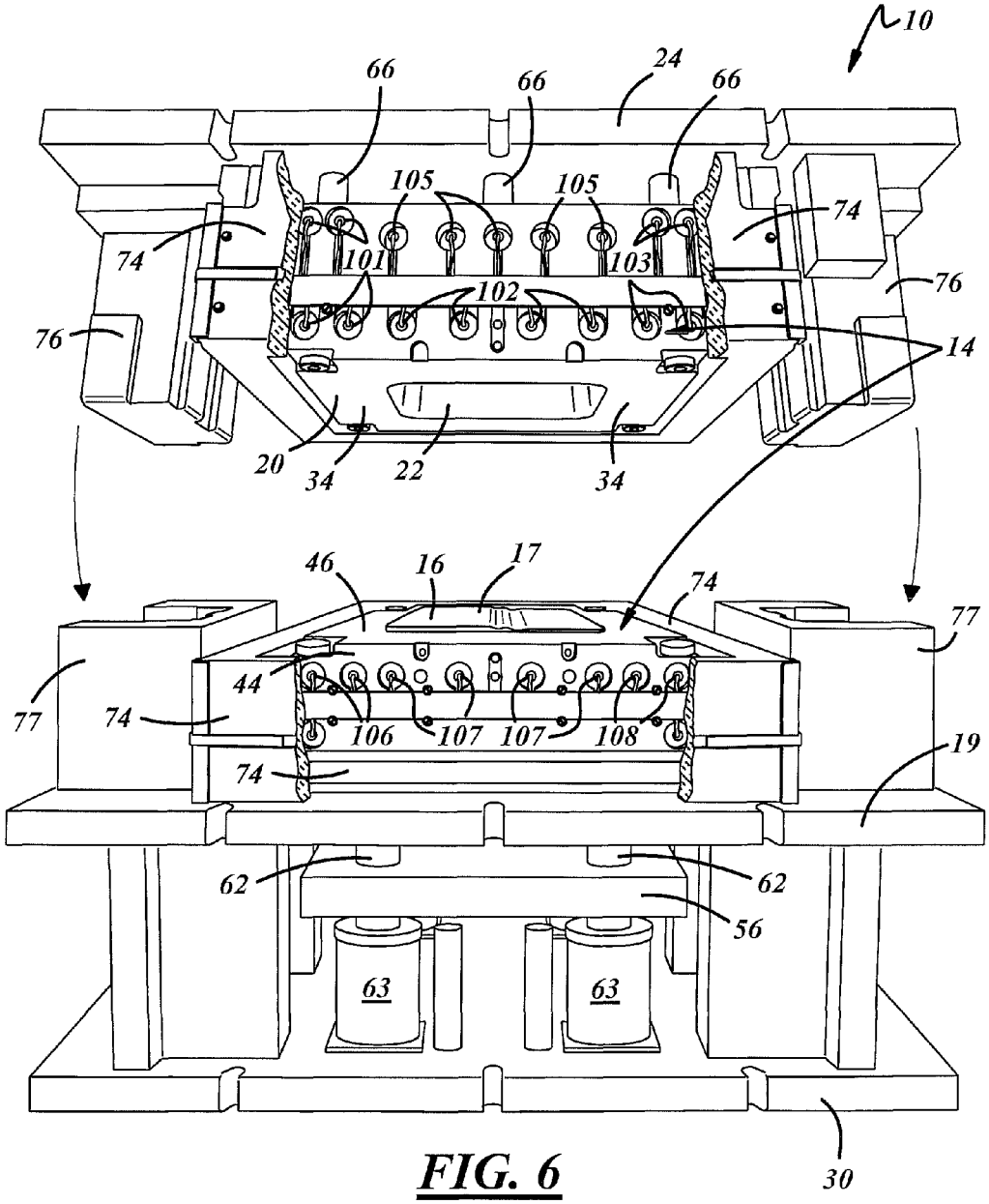
FIG. 6 is a perspective view of the apparatus of FIG. 1 with an upper portion of the apparatus shown removed from a lower portion of the apparatus.

The die set 14 may also include a third die such as a die block or blank holder ring. As best shown in FIGS. 2 and 6, the third die part 44 may have an upper clamp surface 46 shaped and positioned to engage a lower surface of the second region 36 of a sheet material workpiece 15 whose first portion is positioned between the upper and lower die parts. The third die part blank holder ring 44 may be supported for reciprocal motion relative to the upper die part 20 such that closure of the upper die part 20 along the first stroke portion against the third die part blank holder ring 44 will clamp the first portion of the workpiece 15 between the upper and third die parts as shown in FIG. 3. The third die part 44 is supported for reciprocal motion relative to the lower die part 16 such that, once the first portion of a workpiece 15 has been clamped between the upper and third die parts the draw region 47 of the workpiece 15 extending adjacent an interface between the first and second portions 18, 36 of the workpiece 15 can be drawn by displacing the lower die part 16 upward relative to the clamped-together upper and third die parts 20, 44 along a second portion of the die set stroke as shown in FIG. 4.

Figure 7:
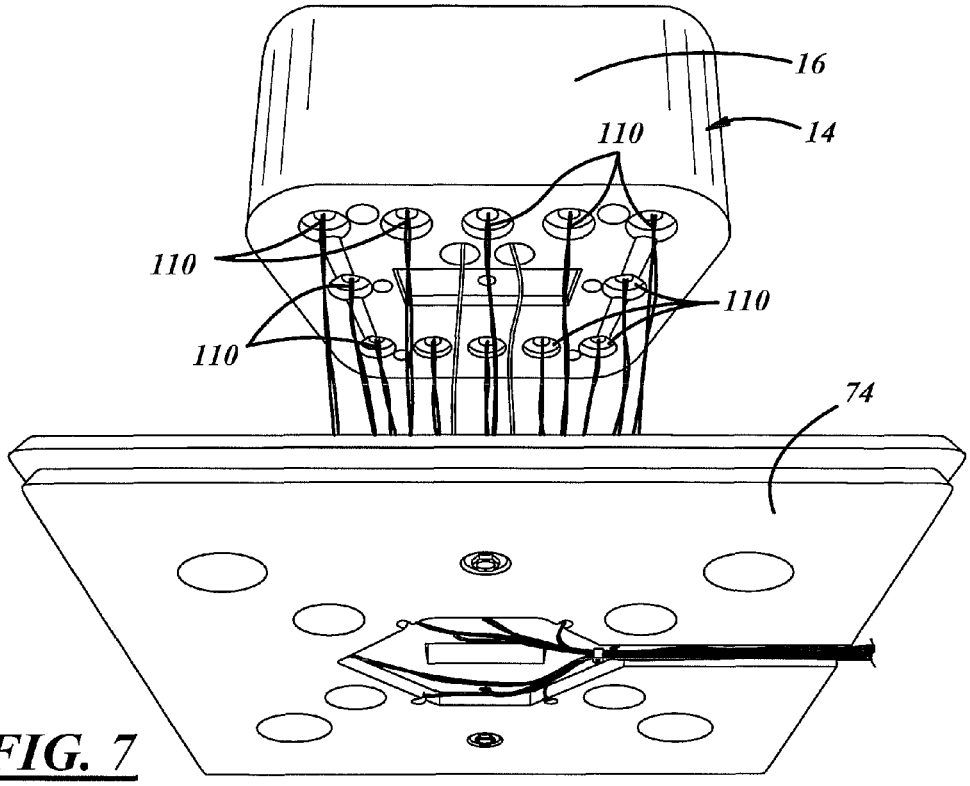
FIG. 7 is a bottom perspective view of a punch and sheet of insulation board of the apparatus of FIG. 1.
Figure 8:
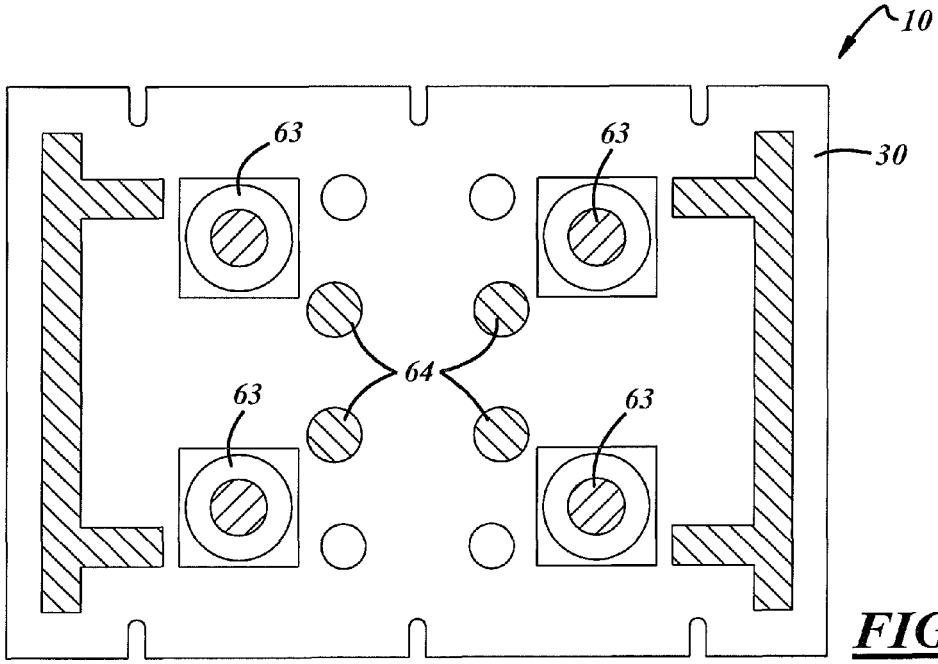
FIG. 8 is a cross sectional view of the apparatus taken along line 8-8 of FIG. 2.
Figure 10:
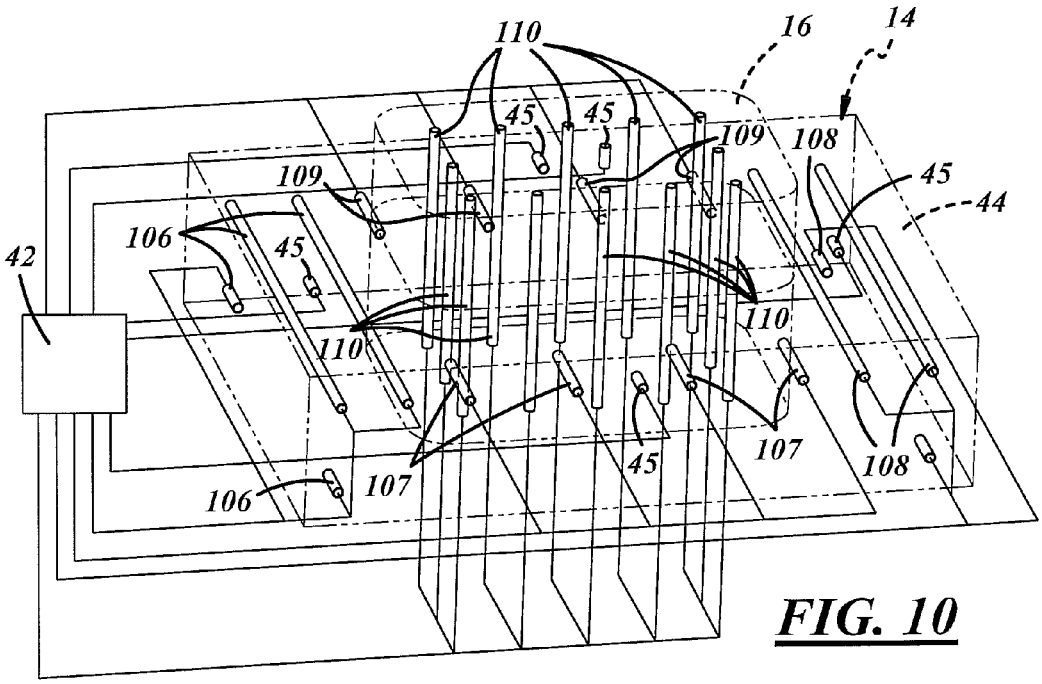
FIG. 10 is an orthogonal view of heat cartridge and thermocouple placement within a phantom orthogonal view of punch and die ring components of the apparatus of FIG. 1.

The die apparatus 10 may also include a heater or plurality of electrical resistance cartridge heaters 101, 102, 103, 104, 105 of a type known as Firerod™ available from Watlow and carried by and in thermal communication with the upper die part 20. Additional electrical resistance cartridge heaters or pluralities of heaters 110, which may be of the same type as the first plurality of heaters 101-105, may be in thermal communication with and carried by the lower die part 16 as best shown in FIGS. 7 and 10. A temperature controller 42 may be connected to the heaters 101-105, 110 and programmed to maintain the lower forming surface 19 of the upper die part 20 and the upper forming surface 17 of the lower die part 16 within respective predetermined temperature ranges by controlling power application to the heaters 101-105, 110. This arrangement enhances the formability of sheet material workpieces 15 comprising materials such as sheet aluminum and magnesium.

Additional electrical resistance cartridge heaters or pluralities of such heaters 106, 107, 108, 109 may be disposed in thermal communication with and carried by the third die part blank holder ring 44. A temperature controller 42 may be connected to the heaters 106-109 of the blank holder ring 44 and may be programmed to maintain the draw region 47 of the workpiece 15 within a predetermined temperature range by controlling power application to any one or more heaters or pluralities of heaters 101-110 to provide more precise control of the temperature or temperatures being maintained in the draw region 47 of the workpiece 15. Where aluminum or magnesium are being formed the temperature controller 42 may be programmed to maintain temperature ranges falling within an overall range of 150 C to 400 C.

The heaters or pluralities of heaters 101-110 may be positioned in the upper die part 20, the lower die part 16, and or the blank holder ring 44 using numerical thermal finite element and optimization analysis. The placement of heaters 101-110 may be optimized so that a desired temperature distribution will be produced within the die set 14 and forming surfaces of the upper and lower die parts 20, 16 are maintained within predetermined temperature ranges.

The heaters 101-110 may be divided between a plurality of die set heating zones, each such heating zone being defined as a portion or region of the die set whose temperature is separately-controlled by the controller 42. For example, one such zone may include heaters 101-104, 106-109, and 110, which are disposed in the die set adjacent the draw region 47 of a workpiece 15. Another heating zone may include heaters 105 and 110 disposed in the die set adjacent the first region of such a workpiece 15. Temperature sensors, such as thermo-couples 45, may be disposed in the die set within respective heating zones 201-210 in positions to sense zone temperatures and may be electrically coupled to the temperature controller 42. The temperature controller 42 may be programmed to maintain various portions of the workpiece 15 such as the draw portion and the first portion of the workpiece 15 within respective predetermined temperature ranges by controlling power application to the heaters 101-110 disposed in the respective heating zones in response to temperature feedback signals received from the temperature sensors. This arrangement enhances formability of workpieces 15 by allowing non-isothermal forming conditions to be maintained within the die set.

The apparatus 10 may include a thermal isolator disposed adjacent the die set 14 to reduce the amount of heat energy conducted from the die set 14 and any workpiece 15 carried by the die set 14 to allow the apparatus 10 to function as a stamping die by preventing die distortion and the overheating of press components. In other words, the thermal isolator helps to isolate the heat in the die set 14, i.e., the forming part of the die. This prevents heat from going into the press 12 and damaging press components and prevents the die set 14 from losing heat and developing a thermal gradient that could lead to both an unwanted thermal distribution in the tool and/or die distortion which cause non-optimal forming of workpieces 15. Thermal isolation also allows matched surfaces of a matched die set 14 to remain matched despite the maintenance of high forming temperatures within the die set.

The thermal isolator may include a cooling system comprising an upper plate cooling element 50 in thermal communication with the upper plate 24 carrying the upper die part 20 and engageable by an upper platen 26 of a press 12 carrying the apparatus 10, a sub plate cooling element 52 in thermal communication with the sub plate 19 carrying the lower die part 16 and carried by a lower plate 30 supportable on a lower platen 28 of a press 12 carrying the apparatus 10, and a cushion plate cooling element 54 in thermal communication with a cushion plate 56 carrying the third die part blank holder ring 44 and carried by a lower plate 30 supportable on a lower platen 28 of a press 12 carrying the apparatus 10. The cooling system may be a fluid cooling system in which the cooling elements 50, 52, 54 comprise heat exchangers embedded in and configured to transfer heat energy from the upper plate 24, the sub plate 19 and the cushion plate 56 to a coolant fluid and to circulate the coolant fluid through at least one additional heat exchanger 60 disposed remote from the apparatus 10 and configured to transfer heat energy from the coolant fluid to an ambient air mass.

The thermal isolator may also include four blankholder support pillars 62 comprising a material, such as stainless steel, having relatively low thermal conductivity and suitable compression strength, and supporting the third die part blank holder ring 44 on the cushion plate 56 carried by the lower plate 30 to provide further thermal isolation of the die set 14 from the press 12. A cushion may be disposed between the four blankholder support pillars 62 and the lower plate 30 to control the rate of force application to the draw region 47 of a workpiece 15 during the second portion of the die set stroke to control flow of workpiece 15 material into the cavity 22 of the upper die part 20. If the rate of force application were not controlled a break could occur in the workpiece 15 preventing workpiece 15 material from being drawn into the cavity 22. In other embodiments, the apparatus 10 may be adapted for double action operation, in which case the rate of force application could be controlled by controlling press motion The cushion may include 4 nitrogen cushion cylinders 63 supporting a cushion plate 56 supporting the four blankholder support pillars 62.

The thermal isolator may also include four punch support pillars 64 comprising a material, such as stainless steel, having relatively low thermal conductivity and suitable compression strength, and supporting the lower die part 16 on the lower plate 30 to provide thermal isolation of the lower die part punch 16 from a lower platen 28 of a press 12 carrying the apparatus 10. The punch support pillars 64 may extend only from the sub plate 19 to a portion of the lower plate 30 carrying the punch as shown in the drawings, or may extend through the sub plate 19 to the punch.

Figure 5:
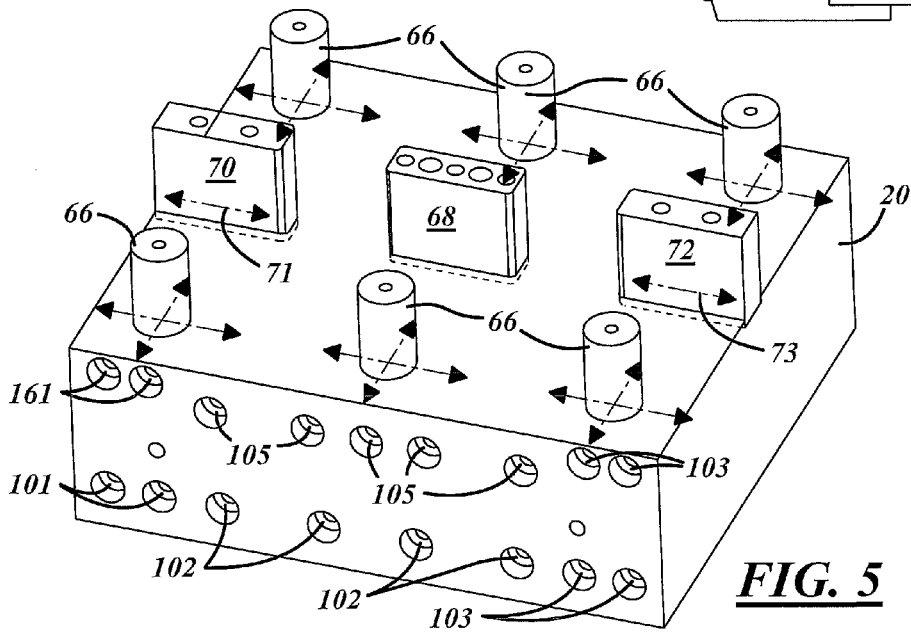
FIG. 5 is a perspective top view of the upper die part and upper die pillars of the apparatus of FIG. 1.

As best shown in FIG. 5, the thermal isolator may further include nine upper die pillars 66 that are fixed to the upper plate, that each comprise a material, such as stainless steel, having relatively low thermal conductivity and suitable compression strength, and that space the upper die part 20 from the upper plate 24 to further thermally isolate the die set 14 from the upper platen 26 of a press 12.

A first pillar 68 of the upper die pillars 66 may be fastened to the upper die part 20 at a centroid of the upper die part 20. A second pillar 70 of the upper die pillars 66 may be keyed to the upper die part 20 in a direction allowing for upper die part 20 expansion along a first line of symmetry/neutral axis 71 extending between the fixed first pillar 68 and the keyed second pillar 70 to control expansion and prevent distortion in the upper die part 20 during heating of the upper die part 20. A third pillar 72 of the upper die pillars 66 may be keyed to the upper die part 20 in a direction allowing for upper die part 20 expansion along a second line of symmetry/neutral axis 73 extending between the fixed first pillar 68 and the keyed third pillar 72 to further control expansion and prevent distortion in the upper die part 20 during heating of the upper die part 20. The remaining upper die pillars 66 may not be keyed to the upper die part 20 so as to allow the upper die part to expand and contract in any horizontal direction relative to those pillars.

The thermal isolator may also include insulating material such as insulation board 74 disposed between the upper die part 20 and the upper plate 24 to further reduce heat transfer from the die set 14 to the upper platen 26 of a press 12 carrying the apparatus 10. Insulation board 74 or other suitable insulating material may also be disposed between the lower die part 16 and the sub plate 19 to further reduce heat transfer from the lower die part 16 through the sub plate 19 to other portions of the apparatus 10 and to a lower platen 28 of a press 12 carrying the apparatus 10. Insulation board 74 or other suitable insulating material may also be supported around a periphery of the die set 14 to reduce radiant heat transfer from the die set 14. Suitable insulation board may be acquired from BNZ Materials.

The apparatus 10 may include upper and lower die blocks 76, 77 disposed between the upper plate 24 that carries the upper die part 20 and the sub plate 19 that carries the lower die part 16. The two die blocks 76 may be disposed in respective positions on either side of the die set 14, thermally insulated from heat generated by the die set 14, and configured to cooperate with the punch 16 and upper die cavity 22 in guiding die motion along the die set stroke.

In practice, an elevated temperature forming die apparatus 10 of the type described above can be made by providing the lower die part or punch 16 so as to include an upper forming surface configured to engage a lower surface of a first region 18 of a sheet material workpiece 15. The lower die part 16 may be supported on the cooled sub plate 19 to reduce heat transferred from the lower die part 16, and the upper die part 20 may then be provided and supported for reciprocal motion relative to the lower die part 16 in response to the relative reciprocal motion of upper and lower platens 26, 28 of a press 12 between which the apparatus 10 is disposed. The upper die part 20 may be supported below the cooled upper plate 24 to reduce heat transferred from the upper die part 20, and upper die pillars 66 may be positioned between the cooled upper plate 24 and the upper die part 20 using a numerical thermal finite element and optimization analysis to provide a desired temperature distribution within the die set 14. The heights of the upper die pillars 66 may also be determined using a numerical thermal finite element and optimization analysis.

The third die part (die block or blankholder ring) 44 may then be provided to include an upper clamp surface 46 shaped and positioned to engage a lower surface of the second region 36 of a sheet material workpiece 15 whose first portion is positioned between the upper and lower die parts 16. The third die part blank holder ring 44 may be supported for reciprocal motion relative to the upper die part 20 such that closure of the upper die part 20 along the first stroke portion against the third die part blank holder ring 44 will clamp the first portion of a workpiece 15 between the upper and third die parts. The third die part may further be supported for reciprocal motion relative to the lower die part 16 such that, once the first portion of a workpiece 15 has been clamped between the upper and third die parts the draw region 47 of the workpiece 15 extending adjacent an interface between the first and second portions of the workpiece 15 can be drawn by displacing the lower die part 16 relative to the clamped-together upper and third die parts along a second portion of the die set stroke.

One or more electrical resistance cartridge heaters or pluralities of heaters 110 may be provided in thermal communication with and installed by being embedded in the lower die part 16, one or more heaters or pluralities of heaters 101-105 may be disposed in thermal communication with and installed by being embedded in the upper die part 20, and one or more heaters or pluralities of heaters 106-109 may be disposed in thermal communication with and installed by being embedded in the third die part blank holder ring 44. The draw region 47 of the workpiece 15 may then be maintained within a predetermined temperature range by controlling power application to any one or more heaters or pluralities of heaters 101-110 disposed in thermal communication with the upper die part 20, the lower die part 16, and the die block ring 44, respectively. The lower forming surface of the upper die part 20 and the upper forming surface of the lower die part 16 may also be maintained within respective predetermined temperature ranges by controlling power application to the heaters 101-110.

Figure 9:
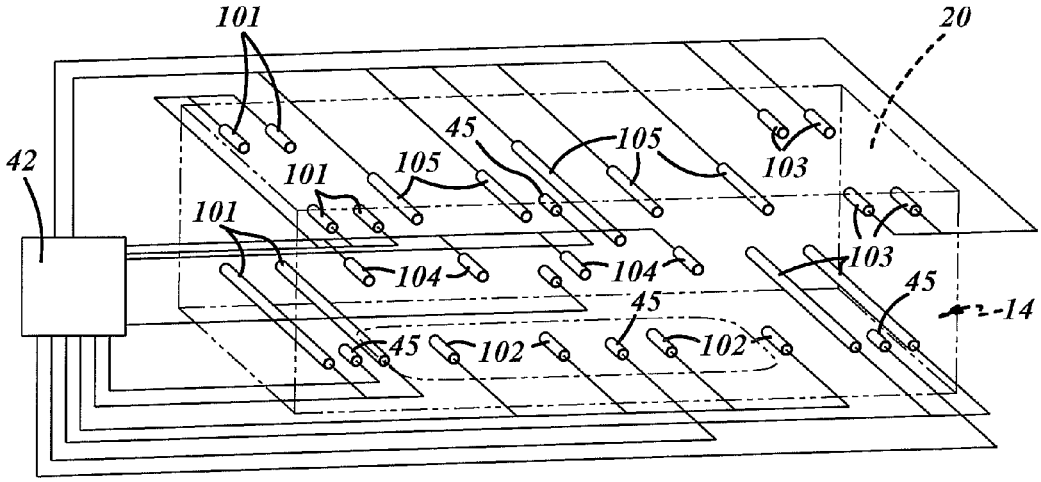
FIG. 9 is an orthogonal view of heat cartridge and thermocouple placement within a phantom orthogonal view of the upper die part of the apparatus of FIG. 1.

The heaters or pluralities of heaters 101-110 may be positioned in different regions of the die set 14 as shown in FIGS. 9 and 10. The controller 42 may be programmed to establish different heating zones within different respective desired temperature ranges by controlling power application to selected ones or groups of the heaters 101-110. The controller 42 may also be programmed to maintain the different desired temperature ranges of the respective heating zones in response to temperature signals received from the temperature sensors 45.

In other words, the heaters or pluralities of heaters 101-110 may be divided between and located in different heating zones of the die set 14 and may be used to maintain different predetermined target temperature ranges in each heating zone by separately controlling power application to the heaters 101-110 in each of the heating zones. To insure that a desired temperature distribution will be produced within the die set 14, each heater or plurality of heaters 101-110 may be positioned using numerical thermal finite element and optimization analysis.

Figure 12:
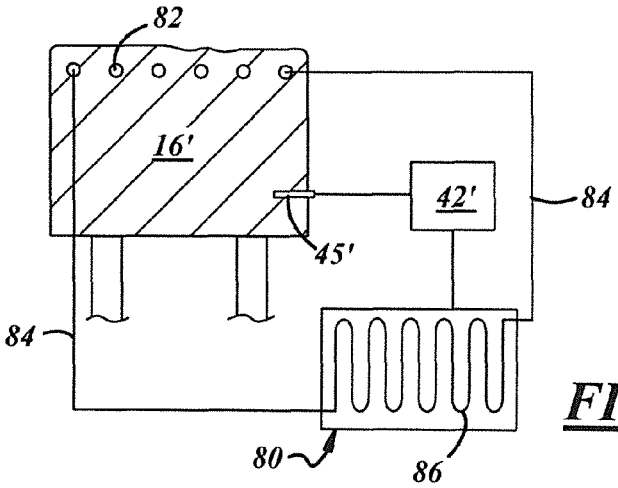
FIG. 12 is a schematic fluid circuit diagram showing a punch cooling system in thermal communication with the punch and including a cooling fluid channel formed in the punch and cooling fluid lines that circulate cooling fluid between the channel and a heat exchanger, and further showing a temperature sensor carried by the punch and connected to a cooling system controller shown connected to the heat exchanger to control punch temperature by controlling heat exchanger operation.

As best shown in FIGS. 9 and 10, at least one temperature effector 110, such as a heater or cooler, may be disposed in a first temperature zone of the die set, and at least one other temperature effector 101-109 may be disposed in a second temperature zone of the die set. As is also best shown in FIGS. 9 and 10, least one temperature sensor 45 may be electrically coupled to the temperature controller 42 and may be disposed in a position to sense a temperature in the first temperature zone. At least one temperature sensor 45 may be electrically coupled to the temperature controller 42 and may be disposed in a position to sense a temperature of the second temperature zone. The temperature controller 42 may be configured to maintain the first temperature zone within a first predetermined temperature range and the second temperature zone within a second predetermined temperature range by controlling power application to the at least one temperature effector disposed in the first temperature zone and the at least one temperature effector 101-109 disposed in the second temperature zone in response to temperature feedback signals received from the respective temperature sensors 45. The second die part or punch 16 may comprise the first temperature zone. At least one of the upper and third die parts, i.e., the cavity 20 and binder ring 44, may comprise the second temperature zone. The controller 42 may be programmed to maintain the first temperature zone at a temperature below that of the second temperature zone to improve formability of workpieces. The second die part or punch 16 may include a first temperature zone of the die set while at least one of the upper and third die parts 20, 44 may comprise a second temperature zone of the die set. At least one heater may be disposed in the second temperature zone of the die set and at least one temperature sensor electrically coupled to the temperature controller and disposed in a position to sense a temperature in the second temperature zone. The temperature controller may be configured to maintain the second temperature zone at a temperature above that of the first temperature zone. As shown in FIG. 12, the punch 16' may alternatively be in thermal communication with a punch cooling system 80 comprising a cooling fluid channel 82 formed in the punch 16' and cooling fluid lines 84 that circulate cooling fluid between the channel 82 and a heat exchanger 86. The punch 16' may include a temperature sensor 45' that is electrically coupled to a controller 42' that is, in turn, electrically coupled to the heat exchanger 86 and programmed to control punch temperature by controlling heat exchanger operation in response to signals received from the temperature sensor 45'.

Therefore, an elevated temperature forming die apparatus 10 constructed according to the invention allows for the controlled drawing of sheet material workpieces 15, limits heat transfer to press and other adjacent components to the extent that die distortion and unwanted thermal gradient variations in the die are reduced sufficiently for the apparatus 10 to function as a stamping die, permits thermal expansion of the die while maintaining dimensional control, enhances sheet material workpiece formability by maintaining non-isothermal forming conditions, and controls die part guidance throughout the stroke of the die set 14.

This description, rather than describing limitations of an invention, only illustrates (an) embodiment(s) of the invention recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. An elevated temperature forming die apparatus for fabrication of deep draw panels from sheet material workpieces having limited formability at lower temperatures, the die apparatus comprising:

a matched stamping die set having a die set stroke and configured to receive a sheet material workpiece and comprising:

a lower die part having an upper surface configured to engage a lower surface of a first region of such a workpiece;

an upper die part supported for reciprocal motion relative to the lower die part along a first portion of the die set stroke between open and closed die set positions, the upper die part having a lower surface configured to engage an upper surface of a second region of a sheet material workpiece;

at least one heater carried by one of the upper and lower die parts;

a temperature controller connected to the at least one heater and configured to maintain at least one of the lower surface of the upper die part and the upper surface of the lower die part within a predetermined temperature range by controlling power application to the at least one heater; and the die set including a third die part having an upper surface configured to engage a lower surface of the second region of a sheet material workpiece whose first portion is positioned between the upper and lower die parts, the third die part being supported for reciprocal motion relative to the upper die part such that closure of the upper die part along the first stroke portion against the third die part will clamp the first portion of the workpiece between the upper and third die parts, and the third die part being supported for reciprocal motion relative to the lower die part such that, once the first portion of a workpiece has been clamped between the upper and third die parts a draw region of the workpiece extending adjacent an interface between the first and second portions of the workpiece can be drawn in plane by displacing the lower die part relative to the clamped-together upper and third die parts along a second portion of the die set stroke.

2. An elevated temperature forming die apparatus as defined in claim 1 in which:

at least one heater is disposed in thermal communication with the third die part; and the temperature controller is connected to the at least one heater in the third die part, the temperature controller being configured to maintain the draw region of the workpiece within a predetermined temperature range by controlling power application to any one or more heaters selected from the group of heaters consisting of the at least one heater disposed in thermal communication with the upper die part, the at least one heater disposed in thermal communication with the lower die part, and the at least one heater disposed in thermal communication with the third die part.

3. An elevated temperature forming die apparatus as defined in claim 1 in which:

at least one temperature effector is disposed in a first temperature zone of the die set;

at least one other temperature effector is disposed in a second temperature zone of the die set; at least one temperature sensor is electrically coupled to the temperature controller and is disposed in a position to sense a temperature in the first temperature zone and at least one temperature sensor is electrically coupled to the temperature controller and is disposed in a position to sense a temperature of the second temperature zone; and the temperature controller is configured to maintain the first temperature zone within a first predetermined temperature range and the second temperature zone within a second predetermined temperature range by controlling power application to the at least one temperature effector disposed in the first temperature zone and the at least one temperature effector disposed in the second temperature zone in response to temperature feedback signals received from the respective temperature sensors.

4. An elevated temperature forming die apparatus as defined in claim 3 in which: the second die part comprises the first temperature zone; at least one of the upper and third die parts comprises the second temperature zone; and the controller is configured to maintain the first temperature zone at a temperature below that of the second temperature zone.

5. An elevated temperature forming die apparatus as defined in claim 1 in which:

the second die part includes a first temperature zone of the die set;

at least one of the upper and third die parts comprises a second temperature zone of the die set;

at least one heater is disposed in the second temperature zone of the die set;

at least one temperature sensor is electrically coupled to the temperature controller and is disposed in a position to sense a temperature in the second temperature zone; and the temperature controller is configured to maintain the second temperature zone at a temperature above that of the first temperature zone.

6. An elevated temperature forming die apparatus as defined in claim 1 in which the apparatus includes a thermal isolator disposed adjacent the die set and configured to reduce the amount of heat energy conducted from the die set and any workpiece carried by the die set.

7. An elevated temperature forming die apparatus as defined in claim 6 in which:

the apparatus is configured to be carried by a single-action press such that relative press motion between an upper platen and a lower platen of the press drives the reciprocal motion of the upper die part relative to the lower die part along the die set stroke; and the thermal isolator includes a cooling system comprising at least one cooling element in thermal communication with at least one apparatus component selected from the group of apparatus components consisting of an upper plate carrying the upper die part and engageable by an upper platen of a single-action press carrying the apparatus, a sub plate carrying the lower die part and supportable on a lower platen of a single-action press carrying the apparatus, and a cushion plate carrying the third die part and supportable on a lower platen of a single-action press carrying the apparatus and configured to draw heat energy from the at least one apparatus component.

8. An elevated temperature forming die apparatus as defined in claim 7 in which the cooling system comprises a fluid cooling system and the at least one cooling element comprises a first heat exchanger configured to transfer heat energy from the at least one apparatus component to a coolant fluid and to circulate the coolant fluid through a second heat exchanger disposed remote from the apparatus and configured to transfer heat energy from the coolant fluid.

9. An elevated temperature forming die apparatus as defined in claim 7 in which the thermal isolator includes at least one pillar supporting the third die part on the lower plate.

10. An elevated temperature forming die apparatus as defined in claim 9 in which a cushion is disposed between the at least one pillar and the lower plate and is configured to control a rate of force application to the draw region of a workpiece during the second portion of the die set stroke.

11. An elevated temperature forming die apparatus as defined in claim 10 in which the cushion includes at least one cushion cylinder.

12. An elevated temperature forming die apparatus as defined in claim 7 in which the thermal isolator includes at least one pillar supporting the lower die part on the lower plate.

13. An elevated temperature forming die apparatus as defined in claim 7 in which the thermal isolator includes at least one pillar supporting the upper die on the upper plate.

14. An elevated temperature forming die apparatus as defined in claim 13 in which the thermal isolator includes insulating material disposed between the upper die and the upper plate.

15. An elevated temperature forming die apparatus as defined in claim 13 in which the thermal isolator includes insulating material between the lower die part and the sub plate.

16. An elevated temperature forming die apparatus as defined in claim 13 in which the thermal isolator includes insulating material supported around a periphery of the die set.

17. An elevated temperature forming die apparatus as defined in claim 13 in which:

the thermal isolator includes at least two pillars fixed to at least one of the upper and lower plates and spacing at least one of the upper and lower dies from the upper and lower plates, respectively;

a first pillar of the at least two pillars is fixed to at least one of the upper and lower die; and a second pillar of the at least two pillars is keyed to at least one of the upper and lower die allowing for die expansion along a horizontal line extending between the first pillar and the second pillar.

18. An elevated temperature forming die apparatus as defined in claim 17 in which a third pillar is keyed to at least one of the upper and lower die parts in a direction allowing for die part expansion along a second line extending between the fixed first pillar and the keyed third pillar.

19. An elevated temperature forming die apparatus as defined in claim 1 in which:

the lower die part is a punch having an upper forming surface for forming at least a portion of an upper surface of a workpiece; and the upper die part includes a lower forming surface shaped for forming at least a portion of a lower surface of a workpiece such that relative movement of the upper and lower die parts to the closed die set position imparts a desired shape to at least a portion of such a workpiece positioned between the upper and lower die parts, the lower forming surface being recessed in a cavity into which the punch is received during the second portion of the die set stroke.

20. An elevated temperature forming die apparatus as defined in claim 1 in which the apparatus includes:

an upper plate carrying the upper die part and a sub plate carrying the lower die part; and two die blocks disposed between the upper plate and the sub plate and configured to guide the relative motion between the upper die part and the lower die part along the die set stroke.

21. An elevated temperature forming die apparatus as defined in claim 1 in which the die set is configured to be carried by a single-action press such that press motion drives the reciprocal motion of the upper die part relative to the lower die part along the die set stroke.

22. An elevated temperature forming die apparatus as defined in claim 1 in which the temperature controller is configured to maintain at least one of the lower surface of the upper die part and the upper surface of the lower die part within the temperature range 150C. to 400C.

23. A method for making and heating an elevated temperature forming die apparatus, the method including the steps of:

providing a matched stamping die set having a die set stroke and comprising:

a lower die part having an upper surface configured to engage a lower surface of a first region of a sheet material workpiece;

an upper die part supported for reciprocal motion relative to the lower die part along a first portion of the die set stroke between open and closed die set positions, the upper die part having a lower surface configured to engage an upper surface of a second region of a sheet material workpiece;

providing at least one heater in thermal communication with one of the lower die part and the upper die part using numerical thermal finite element and optimization analysis to position the at least one heater such that a desired temperature distribution will be produced within the die set such that at least one of the forming surfaces of the upper and lower die parts is maintained within a predetermined temperature range;

maintaining at least one of the lower surface of the upper die part and the upper surface of the lower die part within a predetermined temperature range by controlling power application to the heaters; and providing a third die part having an upper surface configured to engage a lower surface of the second region of a sheet material workpiece whose first portion is positioned between the upper and lower die parts, supporting the third die part for reciprocal motion relative to the upper die part such that closure of the upper die part along the first stroke portion against the third die part will clamp the first portion of the workpiece between the upper and third die parts, and further supporting the third die part for reciprocal motion relative to the lower die part such that, once the first portion of a workpiece has been clamped between the upper and third die parts a draw region of the workpiece extending adjacent an interface between the first and second portions of the workpiece can be drawn in-plane by displacing the lower die part relative to the clamped-together upper and third die parts along a second portion of the die set stroke.

24. The method of claim 23 in which the step of providing a lower die part includes supporting the lower die part on a cooled sub plate positioned to reduce heat transferred from the lower die part.

25. The method of claim 23 in which the step of providing a lower die part includes providing a lower die part comprising a punch.

26. The method of claim 23 in which the step of providing and supporting an upper die part includes supporting the upper die part on a cooled upper plate positioned to reduce heat transferred from the upper die part.

27. The method of claim 23 in which the step of providing and supporting an upper die part includes providing upper die pillars between the cooled upper plate and the upper die part.

28. The method of claim 27 in which the step of providing upper die pillars includes positioning the upper die pillars using a numerical thermal finite element and optimization analysis to provide a desired temperature distribution within the die set.

29. The method of claim 27 in which the step of providing upper die pillars includes determining the heights of the upper die pillars using a numerical thermal finite element and optimization analysis.

30. The method of claim 23 in which the step of providing at least one heater in thermal communication with the lower die part and at least one heater in thermal communication with the upper die part includes providing a first plurality of heaters in thermal communication with the lower die part and a second plurality of heaters in thermal communication with the upper die part.

31. The method of claim 29 in which the step of providing first and second pluralities of heaters includes positioning each heater of the first and second pluralities of heaters using numerical thermal finite element and optimization analysis to position such heaters such that a desired temperature distribution will be produced within the die set such that the forming surfaces of the upper and lower die parts are maintained within predetermined temperature ranges.

32. The method of claim 29 in which the step of maintaining the lower surface of the upper die part and the upper surface of the lower die part within respective predetermined temperature ranges includes positioning the heaters of the first and second pluralities of heaters such that the heaters of the two pluralities of heaters are disposed in at least two separate heating zones of the die set, and maintaining a first of the at least two heating zones within a first desired temperature range by controlling power application to the heaters in a first heating zone and maintaining a second of the at least two heating zones within a second predetermined temperature range by controlling power application to the heaters in the second of the two heating zones.

33. The method of claim 23 in which the step of providing a third die part includes providing at least one heater in thermal communication with the third die part and maintaining the draw region of the workpiece within a predetermined temperature range by controlling power application to any one or more heaters selected from the group of heaters consisting of at least one heater disposed in thermal communication with the upper die part, at least one heater disposed in thermal communication with the lower die part, and at least one heater disposed in thermal communication with the third die part.

34. The method of claim 32 including the additional steps of:

providing a first plurality of heaters in thermal communication with the lower die part;

providing a second plurality of heaters in thermal communication with the upper die part; and providing a third plurality of heaters in thermal communication with the third die part such that the heaters of the three pluralities of heaters are disposed in at least two separate heating zones of the die set; and maintaining a first of the at least two heating zones within a first desired temperature range by controlling power application to the heaters in the first heating zone; and maintaining a second of the at least two heating zones within a second predetermined temperature range by controlling power application to the heaters in the second of the two heating zones.

35. The method of claim 33 in which the step of positioning each heater of the first, second, and third pluralities of heaters includes using numerical thermal finite element and optimization analysis to position such heaters such that a desired temperature distribution will be produced within the die set.

36. The method of claim 23 in which at least one of the lower surface of the upper die part and the upper surface of the lower die part are maintained within a predetermined temperature range of 150C. to 400C.

* * * * *